United States Patent [19]

Schultze et al.

[11] 4,272,491

[45] Jun. 9, 1981

[54] FERRIC LEACHING OF URANIUM VALUES FROM LIGNITE

[75] Inventors: Lawrence E. Schultze, Sparks; Donald J. Bauer; Michael T. Morimoto, both of Reno, all of Nev.

[73] Assignee: The United States of America as represented by the Secretary of the Interior, Washington, D.C.

[21] Appl. No.: 44,814

[22] Filed: Jun. 1, 1979

[51] Int. Cl.[3] ..... C01G 43/00

[52] U.S. Cl. ..... 423/20; 423/3; 423/18

[58] Field of Search ..... 423/3, 6, 7, 18, 20

[56] References Cited

U.S. PATENT DOCUMENTS

| | | | |
|---|---|---|---|
| 2,736,634 | 2/1956 | Gaudon et al. | 423/18 |
| 2,890,933 | 6/1959 | Michal et al. | 423/18 |
| 3,000,696 | 9/1961 | Teichmann | 423/7 |
| 3,092,445 | 6/1963 | Green | 423/18 |
| 4,159,308 | 6/1979 | McLaughlin | 423/3 |

*Primary Examiner*—Edward A. Miller

*Attorney, Agent, or Firm*—William S. Brown; Donald A. Gardiner

[57] ABSTRACT

There is disclosed a process for extracting uranium values from a uranium-containing carbonaceous ore such as lignite. This process includes the step of treating the ore with an aqueous leach solution containing a water-soluble ferric salt.

6 Claims, No Drawings

FERRIC LEACHING OF URANIUM VALUES FROM LIGNITE

TECHNICAL FIELD

This invention relates to a process for extracting uranium values from uranium-containing carbonaceous ores.

BACKGROUND ART

It is known to treat a uranium-containing oxide ore, such as pitchblende, by roasting the ore with 10% anhydrous metallic sulfide, such as $FeS_2$ (pyrite), at gradually increasing temperature. Exemplary of this type of prior art is U.S. Pat. No. 3,152,862 to Fischer.

Furthermore, the use of ferric salts for extracting uranium from non-carbonaceous ores is known. Illustrative of this type of prior art are U.S. Pat. Nos. 2,570,120 to Handley et al, 2,736,634 to Gaudin et al, 2,737,438 to Gaudin, 2,847,275 to Yeager, and 2,894,804 to Sawyer et al. Sawyer et al use a ferric chloride leaching solution containing usually 2–15 pounds $FeCl_3.6H_2O$ per pound of uranium values to be recovered. Gaudin et al use a sulfuric acid leaching solution containing ferric ion, with ferric sulfate or ferric chloride being exemplary sources of the ferric ion. The leaching solution contains an amount of sulfuric acid (sp.gr.1.84) that is greater than or equal to the amount of ferric salt, on a weight basis. U.S. Pat. No. 2,890,933 to Michal et al views Gaudin et al as demonstrating that the presence of ferric ions in leaching solution increases substantially the proportion of uranium that can be leached from an ore (column 1, lines 45–49).

It is also known to recover uranium from carbonaceous materials, with U.S. Pat. Nos. 3,000,696 to Teichmann and 2,925,321 to Mariacher being exemplary of this type of prior art. The approaches in each of these patents requires an oxidation step whereby carbon is oxidized, prior to leaching to recover the uranium values. After the oxidation step, Mariacher roasts the uranium-containing ash with a sulfating agent such as pyrite, and the leaches the residue from the sulfating roast with fresh water, with an aqueous solution acidified with flue gas from the roasting step or with a dilute sulfuric acid.

This and the other prior art of which we are aware is deficient because in recovering uranium from carbonaceous ores, an oxidation step is required prior to any leaching step. This type of step is quite uneconomical from an energy standpoint and also from a time standpoint. Also, sintering often occurs during oxidation of the organic material and this produces a refractory residue. Additionally, much of the prior art uses a sulfuric acide leach solution. This approach results in excessive consumption of the acid and often large quantities of added oxidant are required. Other prior art uses a sodium carbonate leach solution. The difficulty with sodium carbonate is that solubilization of considerable organic material occurs, with a nearly impossible solid-liquid separation and excessive reagent consumption resulting.

DISCLOSURE OF THE INVENTION

It is accordingly one object of the present invention to provide a process that does not require oxidation of the carbon in a carbonaceous ore prior to leaching uranium values from the ore.

A further object of the present invention is to provide a process for the recovery of uranium from carbonaceous ores that is economical from an energy standpoint and from a time standpoint.

A still further object is to provide a process for the recovery of uranium from carbonaceous ores that does not result in excessive consumption of sulfuric acid and that does not require large quantities of added oxidant.

An even further object is to provide a process for recovering uranium from carbonaceous ores that does not result in the solubilization of considerable organic material and thus permits a reasonably facile solid-liquid separation after leaching.

Other objects and advantages of the present invention will become apparent as the description thereof proceeds.

In satisfaction of the foregoing objects and advantages, there is provided by this invention a process for extracting uranium values from a uranium-containing carbonaceous ore. This process includes the step of treating a uranium-containing carbonaceous ore at a temperature of from about 20° to 104° C. with an aqueous leach solution containing a water-soluble ferric salt, whereby uranium values are extracted from the ore. The process does not require an oxidative pretreatment of the ore.

BEST MODE FOR CARRYING OUT THE INVENTION

According to the present invention, a uranium-containing carbonaceous ore such as lignite is extracted with an aqueous leach solution containing a water-soluble ferric salt at a temperature of from about 20° to 104° C. The aqueous leach solution is prepared using a ratio of from 0.12 to 2.0 pounds of hydrated ferric salt per pound of ore. This produces a ferric salt concentration in the range of about 0.8 to 3.4 molar in the leach solution.

Optionally, a minor amount of a mineral acid having the same anion as the anion of the ferric salt is added to the aqueous leach solution. Suitably, up to about 60 pounds of acid per ton of ore is included in the leach solution.

It is particularly suitable for the water-soluble ferric salt to be ferric sulfate or ferric chloride. When ferric sulfate is selected as the ferric salt, sulfuric acid is the mineral acid that is optionally added to the leach solution, and when the ferric salt is ferric chloride, hydrochloric acid is this acid.

Optionally, an anti-foaming agent such as Dow H-10 is added to the leach solution in an amount sufficient to prevent foaming during the extraction.

The ore is suitably treated with the aqueous leach solution at atmospheric pressure. Optimum treatment time varies with the temperature selected, as well as with the concentration of ferric salt in the leach solution. However, generally a period of time between about two or four hours is sufficient for the treatment to be carried out.

Once the treatment step has been completed, the uranium values are recovered from the aqueous leach solution, and the leach solution is recycled following reconstitution if necessary by adding back to the solution the small quantities of ferric salt that may be consumed during the treatment step. Consumption of only a small quantity of the ferric salt is a further advantage of this process.

As a result of this process, higher recoveries of uranium are obtained than is the case with conventional sulfuric acid leaching at equivalent acid strengths. This is another advantage of the process of this invention.

Specific examples of the present invention will now be set forth. Unless otherwise stated, all percentages are by weight and all processing steps are conducted at ambient pressure. It is to be understood that these examples are merely illustrative and are in no way to be interpreted as limiting the scope of the invention.

EXAMPLE 1

A 200 gram portion of uraniferous lignite containing 0.20% $U_3O_8$ is slurried with a leach solution containing 400 grams $Fe_2(SO_4)_3.9H_2O$, 200 ml $H_2O$ and 3.0 ml 96% sulfuric acid. To this solution there is also added an anti-foaming agent (Dow H-10). The slurry is stirred for three hours at 90° to 95° C. The electromotive force of the slurry is determined to be 500 mV using a platinum electrode versus calomel electrode. A 98.6% uranium extraction is obtained.

EXAMPLE 2

A 200 gram portion of uraniferous lignite containing 0.18% $U_3O_8$ is slurried with a leach solution containing 200 grams $FeCl_3.6H_2O$, 150 ml $H_2O$ and 6 ml 36% HCl. The slurry is stirred for three hours at 95° C. The electromotive force of the slurry is measured at 503 mV. A 74% uranium extraction is obtained.

COMPARATIVE EXAMPLE 1

A 200 gram sample of uraniferous lignite containing 0.15% $U_3O_8$ is slurried with a leach solution containing 5 ml 96% sulfuric acid and 400 ml water. The slurry was stirred for six hours at 95° C. A 54.7% uranium extraction is obtained.

Industrial Applicability

This process can be used to extend domestic reserves and resources of uranium. In particular, this process permits the utilization of undeveloped, known deposits of uraniferous lignites.

We claim:

1. A process for extracting uranium values from a uraniterous lignite consisting essentially of treating the lignite at a temperature of from about 20° to 104° C. with a leach solution consisting essentially of an aqueous solution of a ferric salt.

2. The process of claim 1 wherein said ferric salt is present in said leach solution in a concentration of from about 0.8 to 3.4 molar.

3. The process of claim 1 wherein said ferric salt is ferric sulfate.

4. The process of claim 1 wherein said ferric salt is ferric chloride.

5. The process of claim 1 wherein said leach solution further includes a minor amount of a mineral acid having the same anion as the anion of said ferric salt.

6. The process of claim 1 wherein said lignite is treated for a period of time in the range of about two to four hours.

* * * * *